US008188961B2

(12) United States Patent
Liao

(10) Patent No.: US 8,188,961 B2
(45) Date of Patent: May 29, 2012

(54) LIQUID CRYSTAL DISPLAY DEVICE AND METHOD FOR DECAYING RESIDUAL IMAGE THEREOF

(75) Inventor: Yi-Suei Liao, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 1047 days.

(21) Appl. No.: 11/971,213

(22) Filed: Jan. 9, 2008

(65) Prior Publication Data

US 2009/0140968 A1 Jun. 4, 2009

(30) Foreign Application Priority Data

Nov. 30, 2007 (TW) ..... 96145743 A

(51) Int. Cl.
*G09G 3/36* (2006.01)

(52) U.S. Cl. ..... 345/98; 345/211; 345/87

(58) Field of Classification Search ..... 345/87–100, 345/211–214; 315/160–176; 359/245–254
See application file for complete search history.

(56) References Cited

U.S. PATENT DOCUMENTS 7,109,965 B1 9/2006 Lee
2004/0104908 A1* 6/2004 Toyozawa et al. ..... 345/211

FOREIGN PATENT DOCUMENTS

CN 1845233 A 10/2006

* cited by examiner

*Primary Examiner* — Alexander Eisen
*Assistant Examiner* — Christopher E Leiby
(74) *Attorney, Agent, or Firm* — Winston Hsu; Scott Margo

(57) ABSTRACT

By way of enabling a reset signal while turning off a liquid crystal display, a method for decaying residual image of the liquid crystal display is capable of setting the corresponding gate signal of each of a plurality of gate lines of the liquid crystal display based on the enabled reset signal. Accordingly, enhanced discharging processes on all the storage units of the liquid crystal display for fast decaying residual image can be performed via the data switches of the liquid crystal display turned on by the gate signals being set. The reset operation for performing discharging processes in response to the reset signal can be carried out based on a reset circuit for setting all the gate signals to become high-level signals, or based on a charging/discharging module for furnishing a high-level voltage directly to all the gate lines.

14 Claims, 6 Drawing Sheets

LIQUID CRYSTAL DISPLAY DEVICE AND METHOD FOR DECAYING RESIDUAL IMAGE THEREOF

BACKGROUND OF THE INVENTION

1. Field of the Invention

The present invention relates to a liquid crystal display device and related method, and more particularly, to a liquid crystal display device and method for decaying residual image of the liquid crystal display device.

2. Description of the Prior Art

Because liquid crystal display (LCD) devices are characterized by thin appearance, low power consumption, and low radiation, LCD devices have been widely applied in various electronic products such as computer monitors, mobile phones, personal digital assistants (PDAs), or flat panel televisions. In general, the LCD device comprises liquid crystal layers encapsulated by two substrates. By means of varying voltage drops between opposite sides of the liquid crystal layers, the twisted angles of the liquid crystal molecules of the liquid crystal layers can be changed so that the transparency of the liquid crystal layers can also be changed accordingly for illustrating images.

FIG. 1 is a diagram schematically showing the structure of a prior-art thin film transistor liquid crystal display (TFT-LCD) device. As shown in FIG. 1, the TFT-LCD device 10 comprises a liquid crystal display panel 100, a power circuit 150, a source driving circuit 104, a gate driving circuit 106, and a voltage generator 108. As aforementioned, the liquid crystal display panel 100 normally comprises two substrates and liquid crystal layers being stuffed between the substrates. One of the substrates is disposed with a plurality of data lines 110, a plurality of gate lines (or scan lines) 112 perpendicular to the data lines 110, and a plurality of thin film transistors (TFTs) 114. The other one of the substrates is disposed with a common electrode for receiving a common voltage Vcom provided by the voltage generator 108. For the sake of elucidation, FIG. 1 reveals only four thin film transistors 114, but in a real case, there is one thin film transistor 114 disposed at each intersection of a data line 110 and a gate line 112 on the LCD panel 100. That is, the plurality of thin film transistors 114, each corresponding to a pixel of the TFT-LCD device 10, form a matrix on the LCD panel 100, and the data lines 110 and the gate lines 112 are corresponding to columns and rows of the matrix. In addition, an equivalent circuit resulted from the two substrates of the LCD panel 100 can be regarded as a plurality of equivalent capacitors 116. Each of the plurality of equivalent capacitors 116 comprises at least a liquid crystal capacitor and at least a storage capacitor, and functions to act as a storage unit.

The power circuit 150 comprises a plurality of level shifters 151, 152, and 153 for converting a vertical start logic signal STV, a first clock logic signal CLK1L, and a second clock logic signal CLK2L into a vertical start signal ST, a first clock signal CLK1, and a second clock signal CLK2 respectively. The vertical start signal ST, the first clock signal CLK1, and the second clock signal CLK2 are furnished to the gate driving circuit 106. Besides, the power circuit 150 transfers a low-level gate signal reference voltage Vgl to the gate driving circuit 106.

The operation principle for driving the prior-art TFT-LCD device 10 is briefed as the following. When the power circuit 150 receives the vertical start logic signal STV, the first clock logic signal CLK1L, and the second clock logic signal CLK2L, the high/low logic levels of the signals STV, CLK1L, and CLK2L are converted to the high-level/low-level gate signal reference voltages by the power circuit 150 so as to generate the vertical start signal ST, the first clock signal CLK1, and the second clock signal CLK2 forwarded to the gate driving circuit 106. Thereafter, the gate driving circuit 106 and the source driving circuit 104 are able to generate gate signals and data signals furnished to the corresponding gate lines 112 and data lines 110 for controlling the operations of the thin film transistors 114 and the voltage drops across the equivalent capacitors 116. The twisted angles of liquid crystal molecules corresponding to the equivalent capacitors 116 are then changed in response to the voltage drops, and hence the corresponding transparency of the liquid crystal layers can be changed accordingly for illustrating images.

For instance, when the gate driving circuit 106 forwards a gate signal to a gate line 112 for turning on corresponding thin film transistors 114, the data signals forwarded to the data lines 110 by the source driving circuit 104 can be furnished to the corresponding equivalent capacitors 116 via the corresponding thin film transistors 114 being turned on. Consequently, the gray levels of corresponding pixels can be controlled based on the data signals.

However, upon turning off the TFT-LCD device 10, the electric charges accumulated in the equivalent capacitors 116 cannot be discharged rapidly and can only be released through the leakage currents of the thin film transistors 114, which is a time-consuming discharging process. That is, the displayed image cannot vanish immediately after power-off and will persist for a relatively long time, which is known as the residual image effect. The residual image displayed on the TFT-LCD device 10 may cause an unpleasant visual experience.

SUMMARY OF THE INVENTION

In accordance with an embodiment of the present invention, a liquid crystal display device for decaying residual image upon power-off is provided. The liquid crystal display device comprises a source driving circuit, a gate driving circuit, a plurality of parallel data lines, a plurality of parallel gate lines, a plurality of storage units, a plurality of data switches, a reset circuit, and a power circuit.

The source driving circuit is utilized for generating a plurality of data signals corresponding to an image to be displayed. The gate driving circuit is utilized for generating a plurality of gate signals. The plurality of parallel data lines are coupled to the source driving circuit. Each data line is used to receive a corresponding data signal. The plurality of parallel gate lines are coupled to the gate driving circuit and are crossed with the plurality of data lines perpendicularly. Each gate line is used to receive a corresponding gate signal. Each storage unit comprises a first terminal coupled to one corresponding data switch, and a second terminal for receiving a common voltage. Each data switch comprises a first terminal coupled to one corresponding storage unit, a second terminal coupled to one corresponding data line, and a control terminal coupled to one corresponding gate line. The reset circuit comprises a first input terminal for receiving a first clock logic signal, a second input terminal for receiving a second clock logic signal, a third input terminal for receiving a reset signal, a first output terminal, a second output terminal, and a third output terminal, wherein the first output terminal outputs the first clock signal, the second output terminal outputs the second clock signal, and the third output terminal outputs a low-level logic signal when the reset signal is a high-level logic signal, or alternatively, the first output terminal, the second output terminal and the third output terminal are set to output the high-level logic signal when the reset signal is a low-level logic signal. The power circuit comprises a first input terminal for receiving a vertical start logic signal, a second input terminal coupled to the first output terminal of the reset circuit, a third input terminal coupled to the second output terminal of the reset circuit, a fourth input terminal coupled to the third output terminal of the reset circuit, a first output terminal coupled to the gate driving circuit for outputting a vertical start signal, a second output terminal coupled to the gate driving circuit for outputting a first clock signal or a high-level gate signal reference voltage based on the logic signal outputted from the first output terminal of the reset circuit, a third output terminal coupled to the gate driving circuit for outputting a second clock signal or the high-level gate signal reference voltage based on the logic signal outputted from the second output terminal of the reset circuit, and a fourth output terminal coupled to the gate driving circuit for outputting a gate signal reference voltage based on the logic signal outputted from the third output terminal of the reset circuit.

The present invention further provides a liquid crystal display device for decaying residual image. The liquid crystal display device comprises a source driving circuit, a gate driving circuit, a plurality of parallel data lines, a plurality of parallel gate lines, a plurality of storage units, a plurality of data switches, a power circuit, and a charging/discharging module.

The source driving circuit is utilized for generating a plurality of data signals corresponding to an image to be displayed. The gate driving circuit is utilized for generating a plurality of gate signals. The gate driving circuit comprises an input terminal for receiving a low-level gate signal reference voltage. The plurality of parallel data lines are coupled to the source driving circuit. Each data line is used to receive a corresponding data signal. The plurality of parallel gate lines are coupled to the gate driving circuit and are crossed with the plurality of data lines perpendicularly. Each gate line is used to receive a corresponding gate line. Each storage unit comprises a first terminal coupled to one corresponding data line, and a second terminal for receiving a common voltage. Each data switch comprises a first terminal coupled to one corresponding storage unit, a second terminal coupled to one corresponding data line, and a control terminal coupled to one corresponding gate line. The power circuit comprises a first input terminal for receiving a vertical start logic signal, a second input terminal for receiving a first clock logic signal, a third input terminal for receiving a second clock logic signal, a first output terminal coupled to the gate driving circuit for outputting a vertical start signal, a second output terminal coupled to the gate driving circuit for outputting a first clock signal, and a third output terminal coupled to the gate driving circuit for outputting a second clock signal. The charging/discharging module is coupled to the plurality of gate lines for receiving a high-level gate signal reference voltage and a reset signal. The charging/discharging module outputs the high-level gate signal reference voltage to the plurality of gate lines when the reset signal is enabled.

Furthermore, the present invention provides a method for decaying residual image of a liquid crystal display device. The method comprises enabling a reset signal upon turning off the liquid crystal display device, setting a gate signal of each gate line of a plurality of gate lines of the liquid crystal display device based on the reset signal being enabled, turning on each data switch of a plurality of data switches of the liquid crystal display device based on one corresponding gate signal being set, and performing a discharging process on each storage unit of a plurality of storage units of the liquid crystal display device based on one corresponding data switch being turned on.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the present invention will be described in detail with reference to the accompanying drawings. Here, it is to be noted that the present invention is not limited thereto. Furthermore, the step serial numbers concerning the method for fast decaying residual image of a liquid crystal display are not meant thereto limit the operating sequence, and any rearrangement of the operating sequence for achieving same functionality is still within the spirit and scope of the invention.

Figure 1:
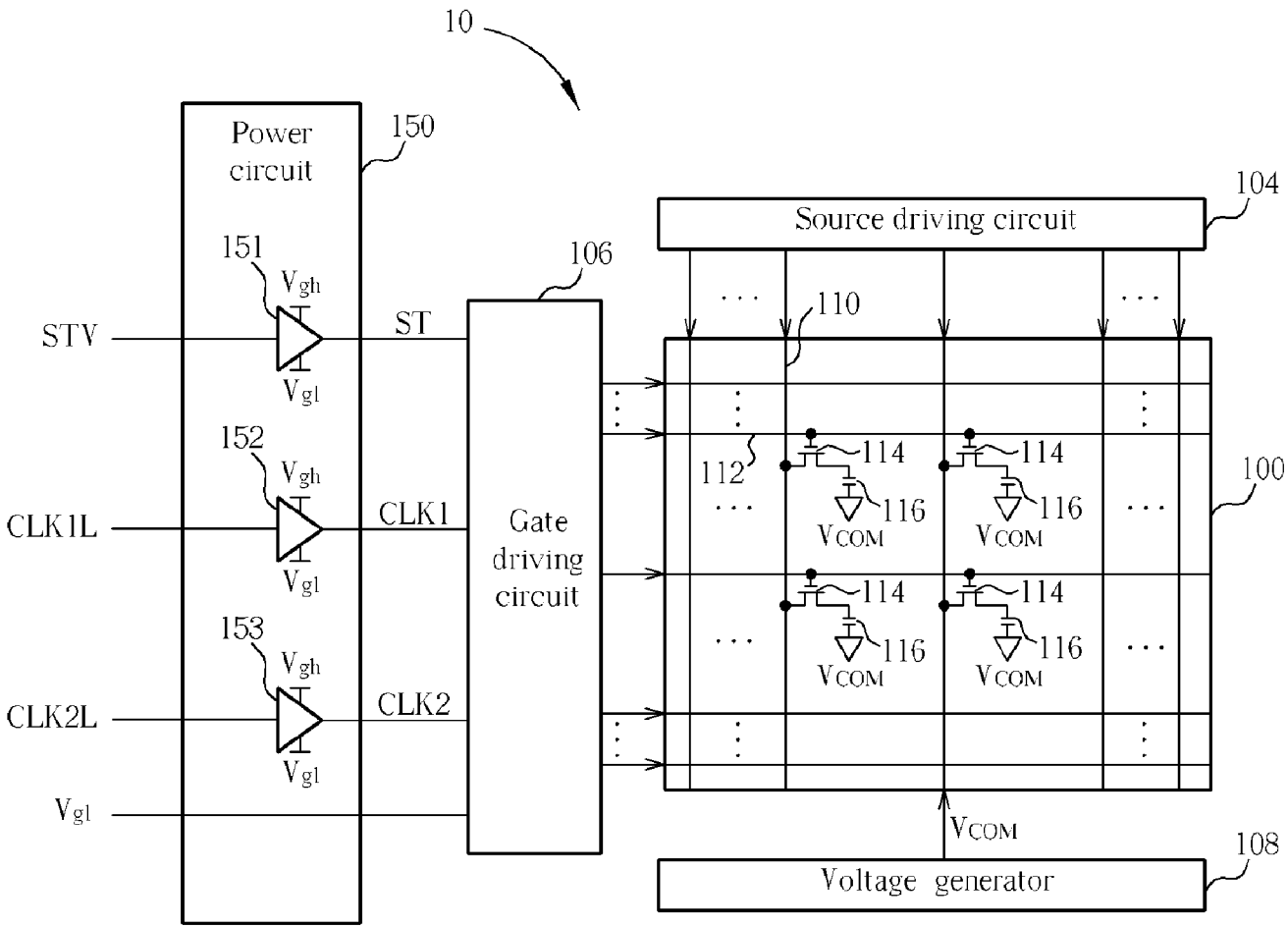
FIG. 1 PRIOR ART
FIG. 1 is a diagram schematically showing the structure of a prior-art thin film transistor liquid crystal display (TFT-LCD) device.
Figure 2:
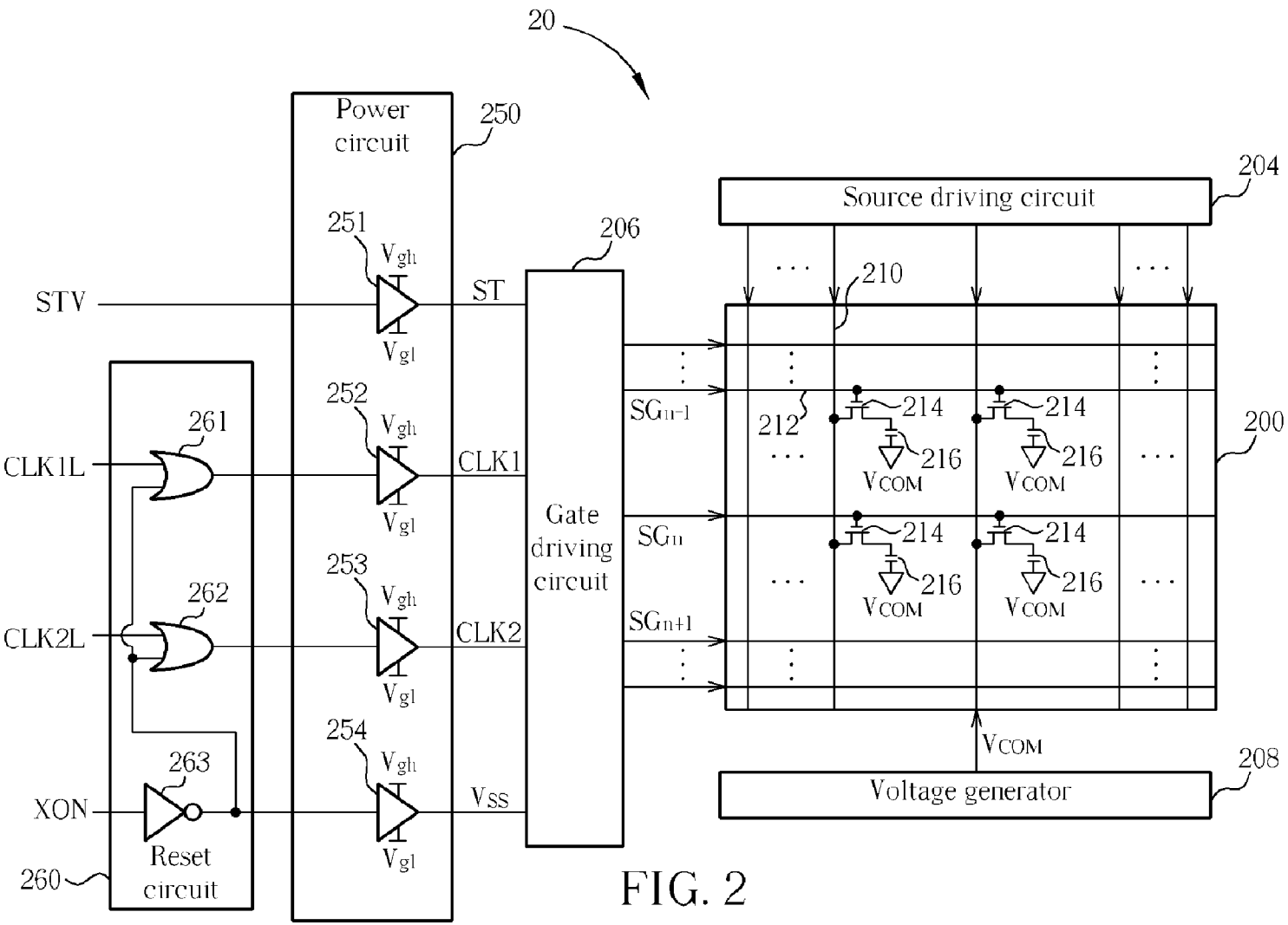
FIG. 2 is a diagram schematically showing the structure of a liquid crystal display device capable of fast decaying residual image in accordance with a first embodiment of the present invention.

FIG. 2 is a diagram schematically showing the structure of a liquid crystal display device for fast decaying residual image in accordance with a first embodiment of the present invention. As shown in FIG. 2, the LCD device 20 comprises a liquid crystal display panel 200, a power circuit 250, a source driving circuit 204, a gate driving circuit 206, a reset circuit 260, and a voltage generator 208. The source driving circuit 204 is utilized to provide a plurality of data signals for displaying images, and the gate driving circuit 206 is utilized to provide a plurality of gate signals.

The liquid crystal display panel 200 comprises two substrates, and liquid crystal layers are stuffed between the substrates. One substrate is disposed with a plurality of data lines 210, a plurality of gate lines 212 perpendicular to the data lines 210, and a plurality of thin film transistors 214. The other substrate is disposed with a common electrode for receiving a common voltage Vcom provided by the voltage generator 208. The plurality of data lines 210 are coupled to the source driving circuit 204, and each of the plurality of data lines 210 receives a corresponding data signal provided by the source driving circuit 204. The plurality of gate lines 212 are coupled to the gate driving circuit 206, and each of the plurality of gate lines 212 receives a corresponding gate signal provided by the gate driving circuit 206.

For the sake of elucidation, FIG. 2 still reveals only four thin film transistors 214, but in a real case, there is one thin film transistor 214 disposed at each intersection of a data line 210 and a gate line 212 on the LCD panel 200. In other words, the plurality of thin film transistors 214, each corresponding to a pixel of the LCD device 20, form a matrix on the LCD panel 200, and the data lines 210 and the gate lines 212 are corresponding to columns and rows of the matrix. Similarly, a circuit effect resulted from the two substrates of the LCD panel 200 can be regarded as a plurality of equivalent capacitors 216. Each of the plurality of equivalent capacitors 216 comprises at least a liquid crystal capacitor and at least a storage capacitor connected in parallel, and functions to act as a storage unit, which has a first terminal coupled to one corresponding data line and a second terminal for receiving the common voltage Vcom. Each thin film transistor 214 comprises a first terminal coupled to one corresponding equivalent capacitor 216, a second terminal coupled to one corresponding data line 210, and a control terminal coupled to one corresponding gate line 212. Each thin film transistor 214 functions as a data switch for controlling a signal connection between the first terminal and the second terminal according to a gate signal received by the control terminal from one corresponding gate line 212, which in turn controls data signal transmission from one corresponding data line 210 to the one corresponding equivalent capacitor 216.

The reset circuit 260 comprises a first input terminal for receiving a first clock logic signal CLK1L, a second input terminal for receiving a second clock logic signal CLK2L, a third input terminal for receiving a reset signal XON, a first output terminal, a second output terminal, and a third output terminal. When the reset signal XON is a high-level logic signal, the first output terminal of the reset circuit 260 forwards the first clock logic signal CLK1L to the power circuit 250, the second output terminal of the reset circuit 260 forwards the second clock logic signal CLK2L to the power circuit 250, and the third terminal forwards a low-level logic signal to the power circuit 250. When the reset signal XON is a low-level logic signal, all the first, second, and third output terminals of the reset circuit 260 are set to forward high-level logic signals to the power circuit 250.

In one preferred embodiment, the reset circuit 260 comprises a buffer 263, a first OR gate 261, and a second OR gate 262. The buffer 263 comprises an input terminal coupled to the third input terminal of the reset circuit 260 for receiving the reset signal XON, and an output terminal coupled to the third output terminal of the reset circuit 260 for outputting an inverted signal of the reset signal XON. In the embodiment shown in FIG. 2, the reset signal XON is a low-level enabled signal, and hence the buffer 263 is an inverting buffer. In another embodiment, if the reset signal XON is a high-level enabled signal, then the buffer 263 is a non-inverting buffer. The first OR gate 261 comprises a first input terminal coupled to the first input terminal of the reset circuit 260 for receiving the first clock logic signal CLK1L, a second input terminal coupled to the output terminal of the buffer 263, and an output terminal coupled to the first output terminal of the reset circuit 260. The second OR gate 262 comprises a first input terminal coupled to the second input terminal of the reset circuit 260 for receiving the second clock logic signal CLK2L, a second input terminal coupled to the output terminal of the buffer 263, and an output terminal coupled to the second output terminal of the reset circuit 260.

The power circuit 250 comprises a plurality of input terminals and a plurality of corresponding output terminals. The power circuit 250 converts the low-level logic voltage of each input signal into a low-level gate signal reference voltage Vgl, and converts the high-level logic voltage of each input signal into a high-level gate signal reference voltage Vgh. In one preferred embodiment, the power circuit 250 comprises a plurality of level shifters 251-254. The level shifter 251 comprises an input terminal for receiving a vertical start logic signal STV, an output terminal coupled to the gate driving circuit 206 for outputting a vertical start signal ST, a high-level input terminal for receiving the high-level gate signal reference voltage Vgh, and a low-level input terminal for receiving the low-level gate signal reference voltage Vgl. The level shifter 252 comprises an input terminal coupled to the first output terminal of the reset circuit 260, an output terminal coupled to the gate driving circuit 206 for outputting a first clock signal CLK1 or the high-level gate signal reference voltage Vgh, a high-level input terminal for receiving the high-level gate signal reference voltage Vgh, and a low-level input terminal for receiving the low-level gate signal reference voltage Vgl.

The level shifter 253 comprises an input terminal coupled to the second output terminal of the reset circuit 260, an output terminal coupled to the gate driving circuit 206 for outputting a second clock signal CLK2 or the high-level gate signal reference voltage Vgh, a high-level input terminal for receiving the high-level gate signal reference voltage Vgh, and a low-level input terminal for receiving the low-level gate signal reference voltage Vgl. The level shifter 254 comprises an input terminal coupled to the third output terminal of the reset circuit 260, an output terminal coupled to the gate driving circuit 260 for outputting a gate signal reference voltage Vss, a high-level input terminal for receiving the high-level gate signal reference voltage Vgh, and a low-level input terminal for receiving the low-level gate signal reference voltage Vgl.

Figure 3:
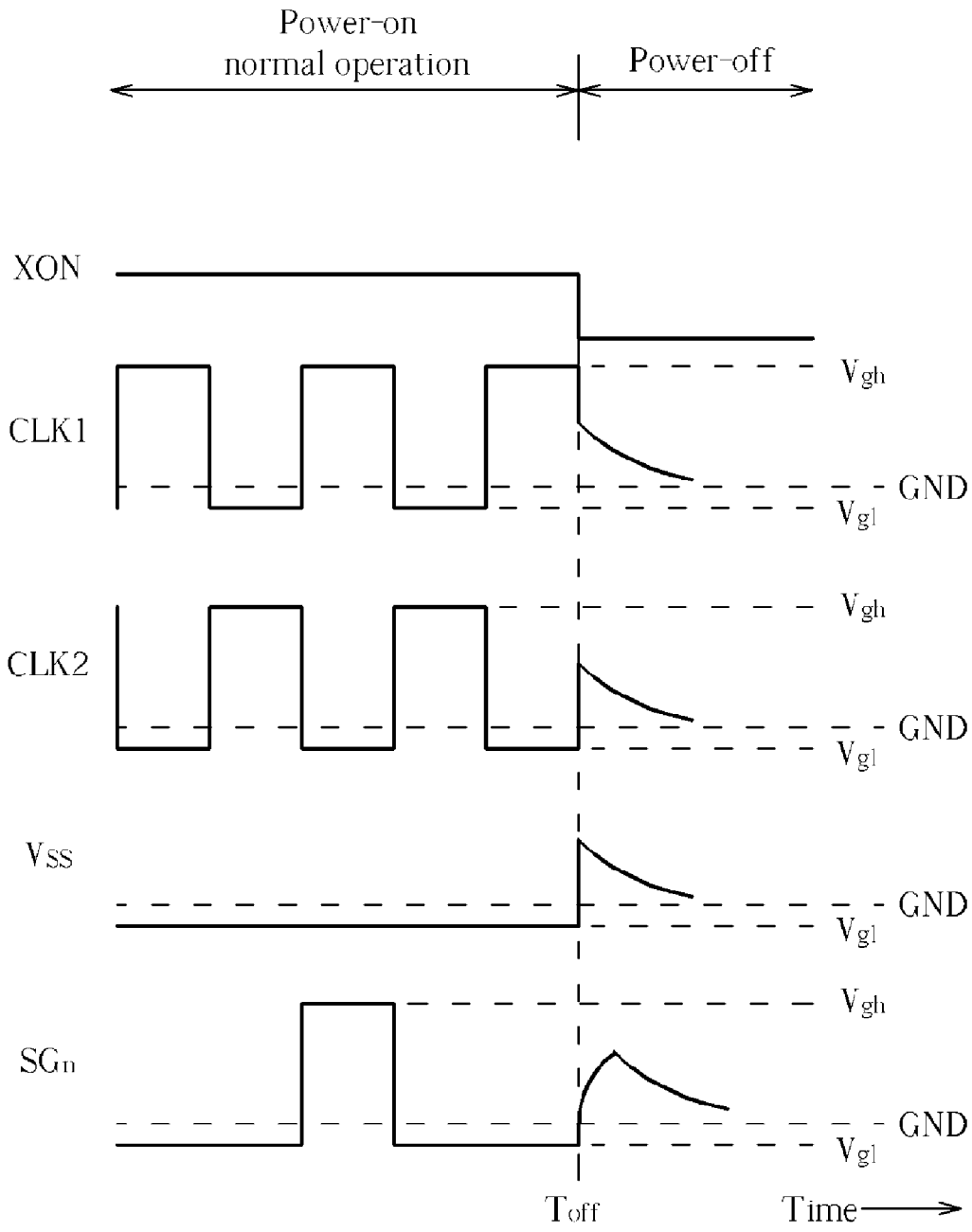
FIG. 3 shows the related signal waveforms concerning the operation of the LCD device in FIG. 2, having time along the abscissa.

FIG. 3 shows the related signal waveforms concerning the operation of the LCD device 20 in FIG. 2, having time along the abscissa. The signal waveforms in FIG. 3, from top to bottom, are the reset signal XON, the first clock signal CLK1, the second clock signal CLK2, the gate signal reference voltage Vss, and the gate signal SGn. The operation principle of the LCD device 20 for fast decaying residual image is detailed with reference to the related timing diagram shown in FIG. 3 as the following.

In normal operation after power-on, the reset signal XON is a high-level logic signal, and hence the buffer 263 outputs a low-level logic signal. Accordingly, the first clock logic signal CLK1L and the second clock logic signal CLK2L can be forwarded to the power circuit 250 via the first OR gate 261 and the second OR gate 262 respectively according to the low-level logic signal outputted from the buffer 263. The power circuit 250 performs signal level conversion processes on the first clock logic signal CLK1L and the second clock logic signal CLK2L for generating the first clock signal CLK1 and the second clock signal CLK2. The reset signal XON undergoes an inverting process by the buffer 263 and a signal level conversion process by the level shifter 254 so as to set the gate signal reference voltage Vss as a low-level gate signal reference voltage Vgl. Besides, the level shifter 251 performs a signal level conversion process on the vertical start logic signal STV for generating the vertical start signal ST. Therefore, the gate driving circuit 206 is able to generate a plurality of gate signals, such as SGn−1, SGn, SGn+1, etc., furnished to the corresponding gate lines 212 based on the vertical start signal ST, the first clock signal CLK1, the second clock signal CLK2, and the gate signal reference voltage Vss. Accordingly, gate scanning processes can be operated normally for illustrating the images to be displayed.

Upon turning off the LCD device 20 at time Toff, the reset signal XON switches from the high-level logic signal to a low-level logic signal, and hence the output of the buffer 263 switches from the low-level logic signal to a high-level logic signal. Accordingly, both the outputs of the first OR gate 261 and the second OR gate 262 turn out to be high-level logic signals, which means that both the first clock logic signal CLK1L and the second clock logic signal CLK2L cannot be forwarded to the power circuit 250 via the reset circuit 260. Consequently, the first clock signal CLK1 and the second clock signal CLK2 are switched to high-level signals. Meanwhile, the gate signal reference voltage Vss is also switched to a high-level signal. That is, all the gate signals on the gate lines 212 are switched to high-level signals for switching on all the thin film transistors 214, and the accumulated charges of all the equivalent capacitors 216 can be discharged speedily. It is noted that the voltage of the high-level signal can not reach the high-level gate signal reference voltage Vgh due to power-off, and the voltage of the high-level signal decreases with time as shown in FIG. 3. However, by making use of the residual power after power-off for switching on all the thin film transistors 214, fast decaying residual image by fast discharging the accumulated charges of all the equivalent capacitors 216 via the thin film transistors 214 can be achieved.

Figure 4:
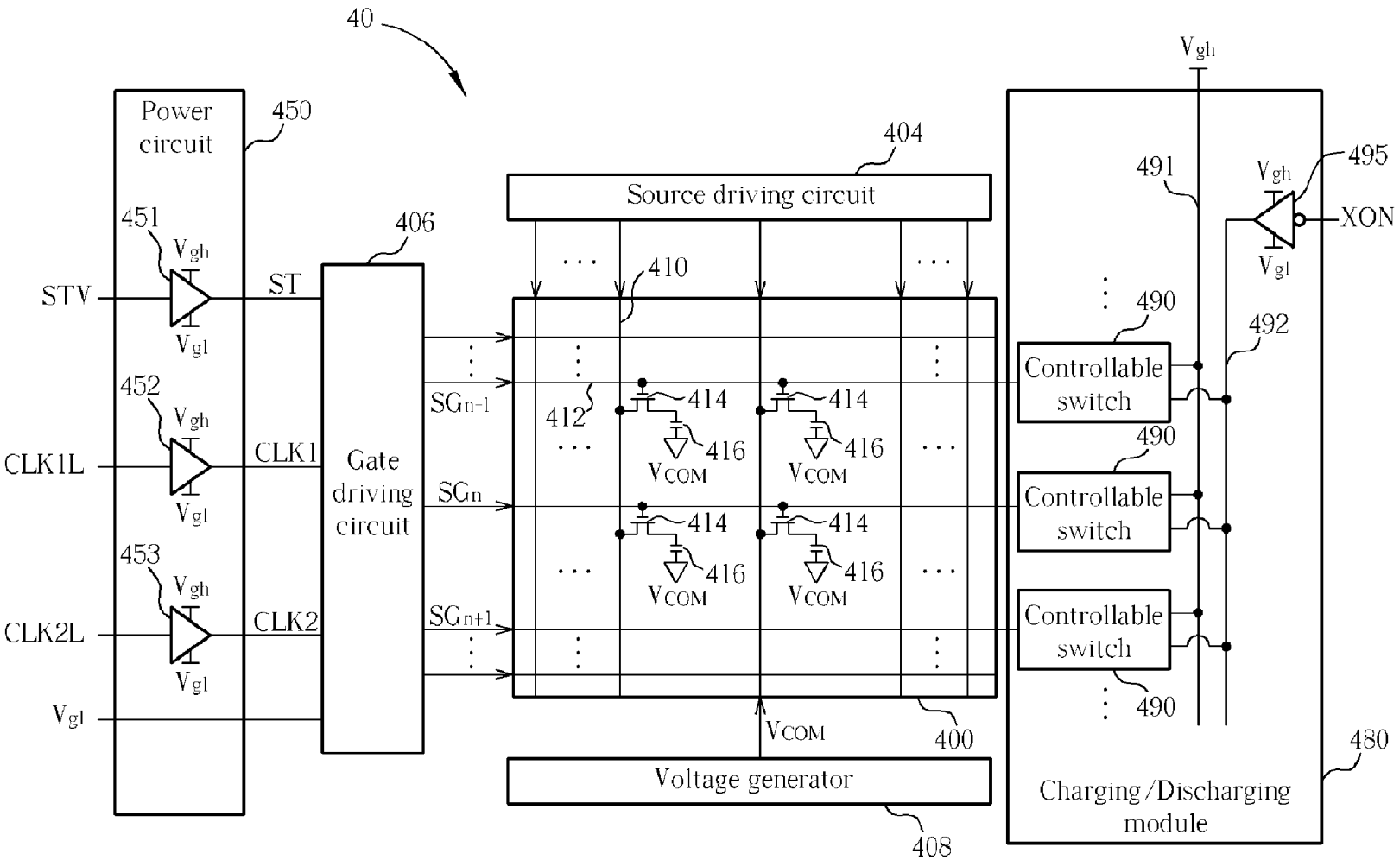
FIG. 4 is a diagram schematically showing the structure of a liquid crystal display device capable of fast decaying residual image in accordance with a second embodiment of the present invention.

FIG. 4 is a diagram schematically showing the structure of a liquid crystal display device for fast decaying residual image in accordance with a second embodiment of the present invention. As shown in FIG. 4, the LCD device 40 comprises a liquid crystal display panel 400, a power circuit 450, a source driving circuit 404, a gate driving circuit 406, a charging/discharging module 480, and a voltage generator 408. The source driving circuit 404 is utilized to provide a plurality of data signals for displaying images, and the gate driving circuit 406 is utilized to provide a plurality of gate signals.

The liquid crystal display panel 400 comprises two substrates, and liquid crystal layers are stuffed between the substrates. One substrate is disposed with a plurality of data lines 410, a plurality of gate lines 412 perpendicular to the data lines 410, and a plurality of thin film transistors 414. The other substrate is disposed with a common electrode for receiving a common voltage Vcom provided by the voltage generator 408.

For the sake of elucidation, FIG. 4 still reveals only four thin film transistors 414, but in a real case, there is one thin film transistor 414, corresponding to a pixel of the LCD device 40, disposed at each intersection of a data line 410 and a gate line 412 on the LCD panel 400. Similarly, a circuit effect resulted from the two substrates of the LCD panel 400 can be regarded as a plurality of equivalent capacitors 416. Each of the plurality of equivalent capacitors 416 comprises at least a liquid crystal capacitor and at least a storage capacitor connected in parallel, and functions to act as a storage unit coupled between one corresponding thin film transistor 414 and the voltage generator 408.

The power circuit 450 comprises a plurality of level shifters 451-453. The level shifter 451 comprises an input terminal for receiving a vertical start logic signal STV, an output terminal coupled to the gate driving circuit 406 for outputting a vertical start signal ST, a high-level input terminal for receiving the high-level gate signal reference voltage Vgh, and a low-level input terminal for receiving the low-level gate signal reference voltage Vgl. The level shifter 452 comprises an input terminal for receiving a first clock logic signal CLK1L, an output terminal coupled to the gate driving circuit 406 for outputting a first clock signal CLK1, a high-level input terminal for receiving the high-level gate signal reference voltage Vgh, and a low-level input terminal for receiving the low-level gate signal reference voltage Vgl.

The level shifter 453 comprises an input terminal for receiving a second clock logic signal CLK2L, an output terminal coupled to the gate driving circuit 406 for outputting a second clock signal CLK2, a high-level input terminal for receiving the high-level gate signal reference voltage Vgh, and a low-level input terminal for receiving the low-level gate signal reference voltage Vgl. Besides, the power circuit 450 may also be used to transfer a low-level gate signal reference voltage Vgl to the gate driving circuit 406. In another embodiment, the low-level gate signal reference voltage Vgl is furnished to the gate driving circuit 406 directly without the aid of the power circuit 450.

The charging/discharging module 480 comprises an inverting level shifter 495, a plurality of controllable switches 490, a power line 491, and a control signal line 492. The inverting level shifter 495 comprises an input terminal for receiving a reset signal XON, an output signal coupled to the control signal line 492, a high-level input terminal for receiving the high-level gate signal reference voltage Vgh, and a low-level input terminal for receiving the low-level gate signal reference voltage Vgl. The inverting level shifter 495 performs an inverting process and a level conversion process on the reset signal XON for generating a control signal. The control signal is transferred to the plurality of controllable switches 490 via the control signal line 492. It is noted that the reset signal XON is a low-level enabled signal for the embodiment shown in FIG. 4. However, in other embodiments, if the reset signal XON is a high-level enabled signal, then the inverting level shifter 495 should be replaced with a non-inverting level shifter. Each of the plurality of controllable switches 490 comprises an output terminal coupled to one corresponding gate line 412, an input terminal coupled to the power line 491 for receiving the high-level gate signal reference voltage Vgh, and a control terminal coupled to the control signal line 492 for receiving the control signal.

Figure 5:
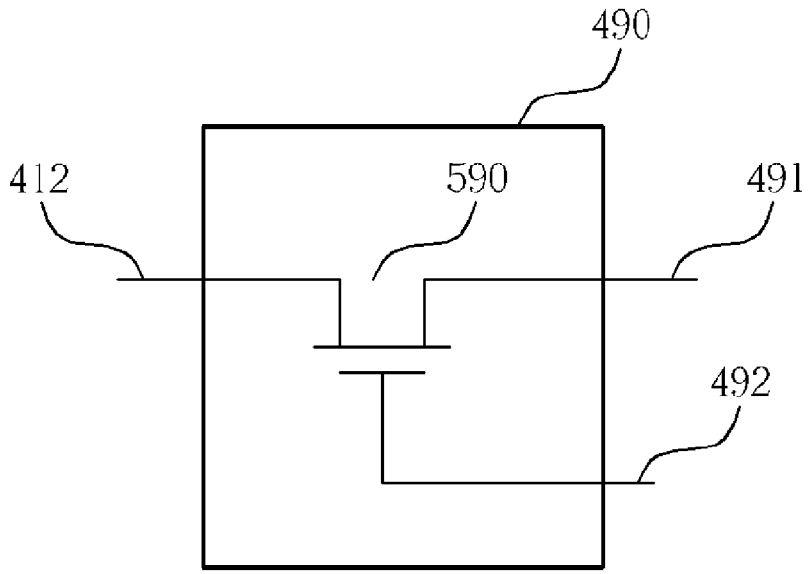
FIG. 5 is a circuit diagram showing the structure of the controllable switch in FIG. 4 in accordance with an embodiment of the present invention.

FIG. 5 is a circuit diagram showing the structure of the controllable switch 490 in FIG. 4 in accordance with an embodiment of the present invention. The controllable switch 490 in FIG. 5 comprises a transistor 590. The transistor 590 comprises a first terminal coupled to one corresponding gate line 412, a second terminal coupled to the power line 491, and a control terminal coupled to the control signal line 492. The transistor 590 can be a thin film transistor, a MOS field effect transistor, or a bipolar junction transistor.

Figure 6:
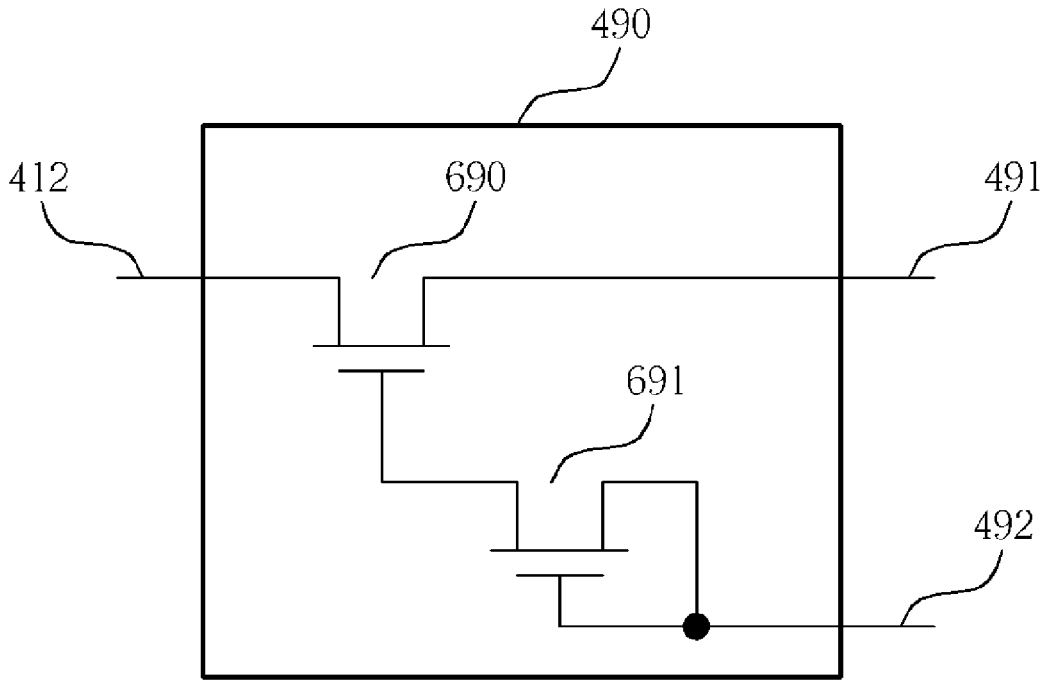
FIG. 6 is a circuit diagram showing the structure of the controllable switch in FIG. 4 in accordance with another embodiment of the present invention.

FIG. 6 is a circuit diagram showing the structure of the controllable switch 490 in FIG. 4 in accordance with another embodiment of the present invention. The controllable switch 490 in FIG. 6 comprises a first transistor 690 and a second transistor 691. The first transistor 690 comprises a first terminal coupled to one corresponding gate line 412, a second terminal coupled to the power line 491, and a control terminal. The first transistor 690 can be a thin film transistor, a bipolar junction transistor, or a MOS field effect transistor. The second transistor 691 comprises a first terminal coupled to the control terminal of the first transistor 690, a control terminal coupled to the control signal line 492, and a second terminal coupled to the control terminal of the second transistor 691. The second transistor 691 can be a thin film transistor, a bipolar junction transistor, or a MOS field effect transistor. When both the first transistor 690 and the second transistor 691 are MOS field effect transistors and are turned on by the control signal via the control signal line 492, the second transistor 691 will be turned off immediately after the first transistor 690 is turned on due to voltage bootstrap effect on the gate capacitor of the first transistor 690. Accordingly, the gate-source driving voltage of the first transistor 690 is sustained for retaining a high discharging efficiency.

The operation principle of the LCD device 40 for fast decaying residual image is detailed as the following. In normal operation after power-on, the reset signal XON is a high-level logic signal, and hence the inverting level shifter 495 outputs a low-level gate signal reference voltage Vgl. Then, the low-level gate signal reference voltage Vgl is furnished to the gates of the controllable switches 490, and the plurality of controllable switches 490 are all turned off for isolating the plurality of gate lines 412 from the power line 491. That is, the high-level gate signal reference voltage Vgh provided by the power line 491 cannot be furnished to the plurality of gate lines 412, and the plurality of gate lines 412 are utilized to receive the gate signals SGn−1, SGn, SGn+1, etc., for performing normal scanning operations so as to illustrate the images to be displayed.

Upon turning off the LCD device 40, the reset signal XON switches from the high-level logic signal to a low-level logic signal, and hence the output of the inverting level shifter 495 switches from the low-level gate signal reference voltage Vgl to a high-level gate signal reference voltage Vgh. Then, the high-level gate signal reference voltage Vgh is furnished to the gates of the controllable switches 490, and the plurality of controllable switches 490 are all turned on for signal connecting between the plurality of gate lines 412 and the power line 491. That is, the high-level gate signal reference voltage Vgh provided via the power line 491 can be furnished to the plurality of gate lines 412. In other words, the gate signals of all the gate lines 412 are switched to have the high-level gate signal reference voltage Vgh, which in turn switch on all the thin film transistors 414. Accordingly, fast decaying residual image by fast discharging the accumulated charges of all the equivalent capacitors 416 via the thin film transistors 414 can be achieved.

Figure 7:
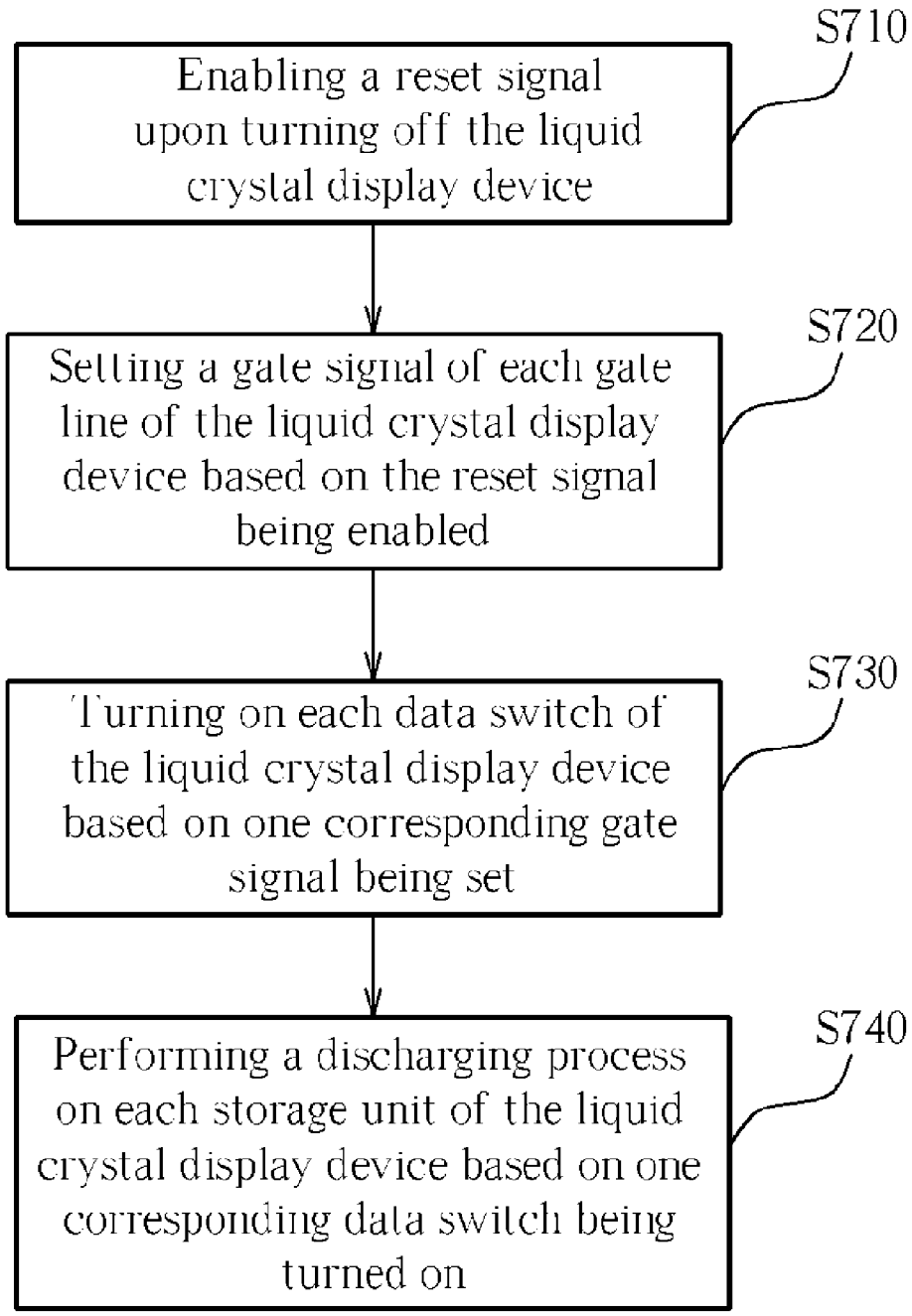
FIG. 7 is a flowchart depicting a method for fast decaying residual image of a liquid crystal display device in accordance with an embodiment of the present invention.

FIG. 7 is a flowchart depicting a method for fast decaying residual image of a liquid crystal display device in accordance with an embodiment of the present invention. The method comprises the following steps:

Step S710: enabling a reset signal upon turning off the liquid crystal display device;

Step S720: setting a gate signal of each gate line of a plurality of gate lines of the liquid crystal display device based on the reset signal being enabled;

Step S730: turning on each data switch of a plurality of data switches of the liquid crystal display device based on one corresponding gate signal being set; and Step S740: performing a discharging process on each storage unit of a plurality of storage units of the liquid crystal display device based on one corresponding data switch being turned on.

In the method for fast decaying residual image of the liquid crystal display device described above, in the step S710, enabling the reset signal upon turning off the liquid crystal display device comprises switching the reset signal to become a low-level logic signal upon turning off the liquid crystal display device. In the step S720, setting the gate signal of each gate line of the plurality of gate lines of the liquid crystal display device based on the reset signal being enabled comprises setting a high-level signal to the gate signal of each gate line of the plurality of gate lines of the liquid crystal display device based on the reset signal being enabled. The step S720 may further comprise decoupling the gate lines from at least one input clock signal.

Furthermore, the step S720 may comprise furnishing a high-level gate signal reference voltage directly to each gate line of the plurality of gate lines of the liquid crystal display device by a charging/discharging module based on the reset signal being enabled. Alternatively, the step S720 may comprise setting a high-level gate signal reference voltage to the gate signal of each gate line of the plurality of gate lines of the liquid crystal display device by a reset circuit coupled to a gate driving circuit of the liquid crystal display device based on the reset signal being enabled.

In the step S730, turning on each data switch of the plurality of data switches of the liquid crystal display device based on one corresponding gate signal being set comprises turning on each thin film transistor of a plurality of thin film transistors of the liquid crystal display device based on one corresponding gate signal being set. In the step S740, performing the discharging process on each storage unit of a plurality of storage units of the liquid crystal display device based on one corresponding data switch being turned on comprises performing the discharging process on each liquid crystal capacitor and each storage capacitor of the plurality of storage units coupled to one corresponding data switch being turned on.

In summary, by way of enabling a reset signal for setting the gate signals of a plurality of gate lines of a liquid crystal display device upon turning off the liquid crystal display device, discharging processes on all the storage units of the liquid crystal display device for fast decaying residual image can be performed via the data switches of the liquid crystal display turned on by the gate signals being set. The reset operation for performing discharging processes in response to the enabled reset signal can be carried out based on a reset circuit for setting all the gate signals to become high-level signals, or alternatively, based on a charging/discharging module for furnishing a high-level voltage directly to all the gate lines.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. A liquid crystal display device comprising:

a source driving circuit for generating a plurality of data signals corresponding to an image to be displayed;

a gate driving circuit for generating a plurality of gate signals;

a plurality of parallel data lines coupled to the source driving circuit for receiving the data signals;

a plurality of parallel gate lines coupled to the gate driving circuit and crossed with the plurality of data lines, for receiving the gate signals;

a plurality of storage units, each of the plurality of storage units comprising:

a first storage unit terminal coupled to one corresponding data line of the plurality of data lines; and a second storage unit terminal for receiving a common voltage;

a plurality of data switches, each of the plurality of data switches comprising:

a first data switch terminal coupled to one corresponding storage unit of the plurality of storage units;

a second data switch terminal coupled to one corresponding data line of the plurality of data lines; and a data switch control terminal coupled to one corresponding gate line of the plurality of gate lines;

a reset circuit comprising:

a first reset input terminal for receiving a first clock logic signal;

a second reset input terminal for receiving a second clock logic signal;

a third reset input terminal for receiving a reset signal;

a first reset output terminal;

a second reset output terminal;

a third reset output terminal;

a buffer comprising a buffer input terminal coupled to the third reset input terminal of the reset circuit for receiving the reset signal, and a buffer output terminal coupled to the third reset output terminal of the reset circuit;

a first OR gate comprising a first primary OR gate input terminal coupled to the first reset input terminal of the reset circuit for receiving the first clock logic signal, a second primary OR gate input terminal coupled to the buffer output terminal of the buffer, and a primary OR gate output terminal coupled to the first reset output terminal of the reset circuit; and a second OR gate comprising a first secondary OR gate input terminal coupled to the second reset input terminal of the reset circuit for receiving the second clock logic signal, a second secondary OR gate input terminal coupled to the buffer output terminal of the buffer, and a secondary OR gate output terminal coupled to the second reset output terminal of the reset circuit; and a power circuit comprising:

a first power input terminal for receiving a vertical start logic signal;

a second power input terminal coupled to the first reset output terminal of the reset circuit;

a third bower input terminal coupled to the second reset output terminal of the reset circuit;

a fourth power input terminal coupled to the third reset output terminal of the reset circuit;

a first power output terminal coupled to the gate driving circuit for outputting a vertical start signal to the gate driving circuit;

a second power output terminal coupled to the gate driving circuit for outputting a first clock signal or a high-level gate signal reference voltage to the gate driving circuit based on a logic signal outputted from the first reset output terminal of the reset circuit;

a third bower output terminal coupled to the gate driving circuit for outputting a second clock signal or the high-level gate signal reference voltage to the gate driving circuit based on a logic signal outputted from the second reset output terminal of the reset circuit; and a fourth power output terminal coupled to the gate driving circuit for outputting a gate signal reference voltage to the gate driving circuit based on a logic signal outputted from the third reset output terminal of the reset circuit, wherein a timing of the plurality of gate signals is controlled according to the first clock signal, the second clock signal, and the vertical start signal.

2. The liquid crystal display device of claim 1, wherein the data switch is a thin film transistor.

3. The liquid crystal display device of claim 1, wherein the storage unit comprises a liquid crystal capacitor.

4. The liquid crystal display device of claim 1, further comprising:

a voltage generator coupled to the plurality of storage units for providing the common voltage.

5. The liquid crystal display device of claim 1, wherein the power circuit comprises:

a first level shifter comprising a first level shifter input terminal coupled to the first power input terminal of the power circuit for receiving the vertical start logic signal, a first level shifter output terminal coupled to the first power output terminal of the power circuit for outputting the vertical start signal, a first high-level input terminal for receiving the high-level gate signal reference voltage, and a first low-level input terminal for receiving a low-level gate signal reference voltage;

a second level shifter comprising a second level shifter input terminal coupled to the second bower input terminal of the power circuit for receiving the logic signal outputted from the first reset output terminal of the reset circuit, a second level shifter output terminal coupled to the second power output terminal of the power circuit for outputting the first clock signal or the high-level gate signal reference voltage based on the logic signal outputted from the first reset output terminal of the reset circuit, a second high-level input terminal for receiving the high-level gate signal reference voltage, and a second low-level input terminal for receiving the low-level gate signal reference voltage;

a third level shifter comprising a third level shifter input terminal coupled to the third power input terminal of the power circuit for receiving the logic signal outputted from the second reset output terminal of the reset circuit, a third level shifter output terminal coupled to the third bower output terminal of the power circuit for outputting the second clock signal or the high-level gate signal reference voltage based on the logic signal outputted from the second reset output terminal of the reset circuit, a third high-level input terminal for receiving the high-level gate signal reference voltage, and a third low-level input terminal for receiving the low-level gate signal reference voltage; and a fourth level shifter comprising a fourth level shifter input terminal coupled to the fourth power input terminal of the power circuit for receiving the logic signal outputted from the third reset output terminal of the reset circuit, a fourth level shifter output terminal coupled to the fourth power output terminal of the power circuit for outputting the gate signal reference voltage based on the logic signal outputted from the third reset output terminal of the reset circuit, a fourth high-level input terminal for receiving the high-level gate signal reference voltage, and a fourth low-level input terminal for receiving the low-level gate signal reference voltage.

6. The liquid crystal display device of claim 1, wherein the buffer is an inverting buffer or a non-inverting buffer.

7. A liquid crystal display device comprising:

a source driving circuit for generating a plurality of data signals corresponding to an image to be displayed;

a gate driving circuit for generating a plurality of gate signals;

a reset circuit comprising:

a first reset input terminal for receiving a first clock logic signal;

a second reset input terminal for receiving a second clock logic signal;

a third reset input terminal for receiving a reset signal;

a first reset output terminal;

a second reset output terminal; and a third reset output terminal, wherein the first reset output terminal outputs the first clock logic signal, the second reset output terminal outputs the second clock logic signal, and the third reset output terminal outputs a low-level logic signal, or alternatively, the first reset output terminal, the second reset output terminal and the third reset output terminal are set to output the high-level logic signal; and a power circuit electrically coupled to the gate driving circuit and the reset circuit, the power circuit comprising:

a first power input terminal for receiving a vertical start logic signal;

a second power input terminal for receiving a logic signal outputted from the first reset output terminal of the reset circuit;

a third bower input terminal for receiving a logic signal outputted from the second reset output terminal of the reset circuit;

a fourth power input terminal coupled to the third reset output terminal of the reset circuit;

a first power output terminal coupled to the gate driving circuit for outputting a vertical start signal to the gate driving circuit;

a second power output terminal coupled to the gate driving circuit for outputting a first clock signal or a high-level gate signal reference voltage to the gate driving circuit based on the logic signal outputted from the first reset output terminal of the reset circuit;

a third power output terminal coupled to the gate driving circuit for outputting a second clock signal or the high-level gate signal reference voltage to the gate driving circuit based on the logic signal outputted from the second reset output terminal of the reset circuit; and a fourth power output terminal coupled to the gate driving circuit for outputting a gate signal reference voltage to the gate driving circuit based on a logic signal outputted from the third reset output terminal of the reset circuit, wherein a timing of each of the plurality of gate signals is generated according to the first clock signal and the second clock signal.

8. The liquid crystal display device of claim 7, further comprising:

a plurality of parallel data lines coupled to the source driving circuit for receiving the data signals;

a plurality of parallel gate lines coupled to the gate driving circuit and crossed with the plurality of data lines, for receiving the gate signals;

a plurality of storage units, each of the plurality of storage units comprising:

a first storage unit terminal coupled to one corresponding data line of the plurality of data lines; and a second storage unit terminal for receiving a common voltage; and a plurality of data switches, each of the plurality of data switches comprising:

a first data switch terminal coupled to one corresponding storage unit of the plurality of storage units;

a second data switch terminal coupled to one corresponding data line of the plurality of data lines; and a data switch control terminal coupled to one corresponding gate line of the plurality of gate lines for receiving one corresponding gate signal of the plurality of gate signals.

9. The liquid crystal display device of claim 8, wherein the data switch is a thin film transistor.

10. The liquid crystal display device of claim 8, wherein the storage unit comprises a liquid crystal capacitor.

11. The liquid crystal display device of claim 8, further comprising:

a voltage generator coupled to the plurality of storage units for providing the common voltage.

12. The liquid crystal display device of claim 8, wherein the power circuit comprises:

a first level shifter comprising a first level shifter input terminal coupled to the first power input terminal of the power circuit for receiving the vertical start logic signal, a first level shifter output terminal coupled to the first power output terminal of the power circuit for outputting the vertical start signal, a first high-level input terminal for receiving the high-level gate signal reference voltage, and a first low-level input terminal for receiving a low-level gate signal reference voltage;

a second level shifter comprising a second level shifter input terminal coupled to the second bower input terminal of the power circuit for receiving the logic signal outputted from the first reset output terminal of the reset circuit, a second level shifter output terminal coupled to the second power output terminal of the power circuit for outputting the first clock signal or the high-level gate signal reference voltage based on the logic signal outputted from the first reset output terminal of the reset circuit, a second high-level input terminal for receiving the high-level gate signal reference voltage, and a second low-level input terminal for receiving the low-level gate signal reference voltage;

a third level shifter comprising a third level shifter input terminal coupled to the third power input terminal of the power circuit for receiving the logic signal outputted from the second reset output terminal of the reset circuit, a third level shifter output terminal coupled to the third bower output terminal of the power circuit for outputting the second clock signal or the high-level gate signal reference voltage based on the logic signal outputted from the second reset output terminal of the reset circuit, a third high-level input terminal for receiving the high-level gate signal reference voltage, and a third low-level input terminal for receiving the low-level gate signal reference voltage; and a fourth level shifter comprising a fourth level shifter input terminal coupled to the fourth power input terminal of the power circuit for receiving the logic signal outputted from the third reset output terminal of the reset circuit, a fourth level shifter output terminal coupled to the fourth power output terminal of the power circuit for outputting the gate signal reference voltage based on the logic signal outputted from the third reset output terminal of the reset circuit, a fourth high-level input terminal for receiving the high-level gate signal reference voltage, and a fourth low-level input terminal for receiving the low-level gate signal reference voltage.

13. The liquid crystal display device of claim 12, wherein the reset circuit comprises:

a buffer comprising a buffer input terminal coupled to the third reset input terminal of the reset circuit for receiving the reset signal, and a buffer output terminal coupled to the third reset output terminal of the reset circuit;

a first OR gate comprising a first primary OR gate input terminal coupled to the first reset input terminal of the reset circuit for receiving the first clock logic signal, a second primary OR gate input terminal coupled to the buffer output terminal of the buffer, and a primary OR gate output terminal coupled to the first reset output terminal of the reset circuit; and a second OR gate comprising a first secondary OR gate input terminal coupled to the second reset input terminal of the reset circuit for receiving the second clock logic signal, a second secondary OR gate input terminal coupled to the buffer output terminal of the buffer, and a secondary OR gate output terminal coupled to the second reset output terminal of the reset circuit.

14. The liquid crystal display device of claim 13, wherein the buffer is an inverting buffer or a non-inverting buffer.

* * * * *